US005407745A

United States Patent [19]

Bankar et al.

[11] Patent Number: 5,407,745

[45] Date of Patent: Apr. 18, 1995

[54] DELUSTERED NYLON FILAMENTS WITH STRIATIONS OF POLYMETHYLPENTENE

[75] Inventors: Vilas G. Bankar; Wae-Hai Tung, both of Seaford, Del.

[73] Assignee: E. I. Du Pont de Nemours and Company, Wilmington, Del.

[21] Appl. No.: 248,897

[22] Filed: May 25, 1994

[51] Int. Cl.[6] ..... D02G 3/00

[52] U.S. Cl. ..... 428/364; 428/372; 428/395; 428/397; 428/400; 428/370; 525/184

[58] Field of Search ..... 428/364, 372, 393, 395, 428/370, 397, 400, 401; 525/84; 526/348.4

[56] References Cited

U.S. PATENT DOCUMENTS

| | | | |
|---|---|---|---|
| 2,205,722 | 6/1940 | Graves . | |
| 3,415,921 | 12/1968 | Mafarren | 526/348.4 |
| 3,729,449 | 4/1973 | Kimura et al. | 525/184 |
| 3,755,500 | 8/1973 | Clark | 526/348.4 |
| 4,540,746 | 9/1985 | Roberts | 525/408 |
| 4,559,196 | 12/1985 | Kobsa et al. | 264/168 |
| 4,711,812 | 12/1987 | Burns | 428/401 |

FOREIGN PATENT DOCUMENTS

| | | |
|---|---|---|
| 745182 | 9/1953 | United Kingdom . |
| 1116202 | 10/1965 | United Kingdom . |

*Primary Examiner*—N. Edwards

[57] ABSTRACT

A delustered nylon filament is disclosed which contains cylindrical striations of polymethylpentene. The filaments have low or no glitter and a bright sheen luster.

7 Claims, 2 Drawing Sheets

DELUSTERED NYLON FILAMENTS WITH STRIATIONS OF POLYMETHYLPENTENE

FIELD OF THE INVENTION

This invention relates to nylon filaments which have been delustered by addition of a polymethylpentene additive.

BACKGROUND OF THE INVENTION

It is often desirable that carpets and fabrics should exhibit a particular luster or sheen without glitter. While the degrees of luster and glitter exhibited by fibers used to make carpets and other fiber products may be rather subjective, there is no question that such qualities exist and that these qualities have a serious impact on the value of the fibers in certain applications.

Luster and glitter in a fiber can be altered, among other means, by introducing additives into the fiber. The additives, generally, must be immiscible with the polymer of the fiber and must have an index of refraction adequately different from that of the fiber polymer so that the additive will scatter light which impinges on the fiber.

Titanium dioxide has been added to nylon to control luster (U.S. Pat. No. 2,205,722), but titanium dioxide makes the fiber appear dull and "chalky" without reducing glitter or sparkle. Polyethylene (U.K. Pat. No. 1,116,202), polypropylene (U.S. Pat. No. 4,711,812) or polystyrene (U.K. Pat. No. 745,182) have also been used as luster additives for nylon. They do not adequately reduce glitter and they also make the fiber appear dull. However, they do not give the chalky appearance which titanium dioxide does. Polyethylene oxide (U.S. Pat. No. 4,540,746) used as a luster additive gives nylon fibers a desirable bright sheen, but also causes the fibers to have lower dye lightfastness than controls of nylon fibers which contain no polyethylene oxide.

Control of luster and glitter is important both for staple (crimped filaments generally having a length in the range of 4–10 inches) and for continuous filament products. "Bulked Continuous Filament" (BCF) yarns are preferably processed in a manner similar to that which has been taught in U.S. Pat. No. 4,559,196 using heated rollers for drawing the filaments and hot air or steam jets for bulking the filaments. Control of luster and glitter can be accomplished by introducing additives into filaments during the filament spinning process, but in subsequent treatment for the manufacture of BCF, there has often been a problem in using organic polymeric fiber additives such as polypropylene, polystyrene, polyethylene oxide or polyethylene because of sticky polymeric debris left on the heated draw rollers. Debris on heated draw rollers is sticky and can cause filaments to become adhered to the rollers and break, thus, disrupting the processing operation.

SUMMARY OF THE INVENTION

The present invention provides a delustered nylon filament having a longitudinal axis and comprising from 0.5 to 10 weight percent of polymethylpentene (based on the total weight of the filament), said polymethylpentene being uniformly distributed in the filament as cylindrical striations having a substantially uniform diameter along their length, an L/D ratio of predominantly 50 to 150, and a longitudinal axis generally parallel with the longitudinal axis of the filament. These filaments have the desired bright sheen or luster and little or no glitter. Heated rolls used in the BCF process are either free of deposits or have a small amount of non-sticky polymeric debris which does not adversely affect the spinning process.

BRIEF DESCRIPTION OF THE INVENTION

DETAILED DESCRIPTION OF THE INVENTION

Figure 1:
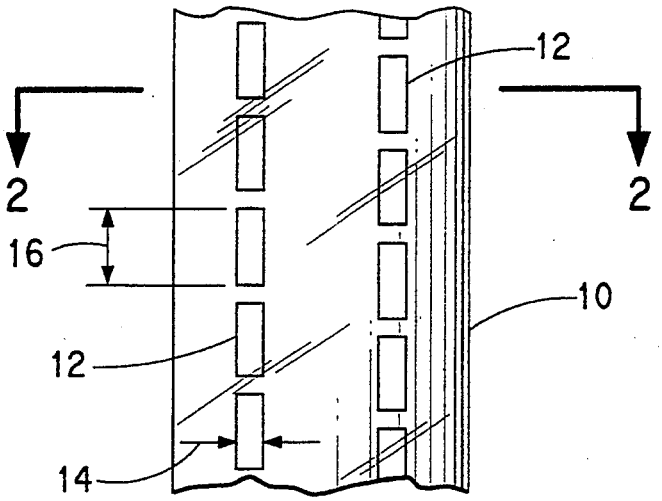
FIG. 1 is an enlarged schematic side view of a nylon filament of this invention.

It has been discovered that polymethylpentene (PMP) can be combined with nylon to make staple filaments or BCF of the desired bright sheen luster and no or low glitter. Using PMP results in either no polymeric debris or a small amount of non-sticky polymeric debris on the heated rollers. Furthermore, nylon filaments containing PMP have substantially the same dye lightfastness in a standard 40 hour xenon arc lightfastness test as control nylon fibers having no PMP.

Polymethylpentenes include the polymers of 2-methyl-1-pentene, 2-methyl-2-pentene, 3-methyl-1-pentene, 3-methyl-2-pentene, and 4-methyl-1-pentene. The preferred PMP is poly(4-methyl-1-pentene) having a Melt Flow Index in the range of 4–80 as measured by ASTM D1238-70 at 260°, 5 kg weight.

Filaments of this invention use a matrix of nylon. By nylon is meant nylon 66 (poly(hexamethylene adipamide)) homopolymer melting point about 260° C.; nylon 6 (polycaproamide) homopolymer, melting point about 230° C.; copolymers of those nylons; copolymers of hexamethylene adipamide and hexamethylene-5-sulfoisophthalamide, melting point about 250°–260° C.; and other copolymers and terpolymers which contain at least 80 weight percent nylon 66 or nylon 6 units and which also contain units of other diacids such as isophthalic acid, terephthalic acid, and the like; and units of other diamines such as 2-methylpentamethylene diamine, and the like. The nylon matrices which can be used in this invention have melting points greater than about 220° C. Filaments should contain at least 80 percent nylon by weight. In addition to PMP, filaments may contain other additives such as, but not limited to, pigments, dyes, stabilizers, flame retardants, and antimicrobial agents.

In the manufacture of the filaments of this invention, the polymethylpentene additive is combined with nylon by melting the additive and the nylon and mixing the melt. The molten mixture of materials is, then, melt spun by processes usually used to spin nylon filaments.

The polymethylpentene additive polymer is effective, for delustering purposes, in amounts from 0.5 to 10 weight percent based on the total weight of the filament. The limits are a matter of convenience. Filaments with concentrations of additive polymer less than 0.5 percent provide some benefit in fiber appearance, but the effect is not great. Filaments with concentrations of additive polymer greater than 10 percent do not exhibit significant luster improvement over fibers having only 10 percent of the additive polymer. Preferably, the nylon filaments contain from about 0.5 to about 3 weight percent polymethylpentene.

Figure 2:
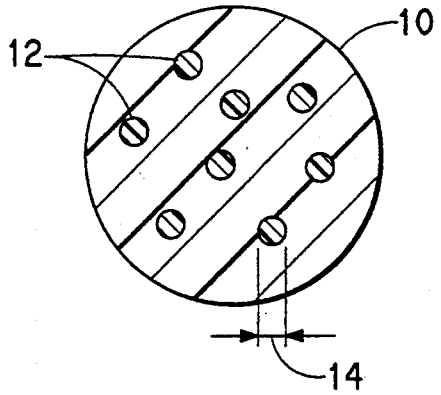
FIG. 2 is an enlarged schematic view of a cross-section of the nylon filament of FIG. 1 taken along line 2—2.

Referring to FIG. 1, polymethylpentene additive, melt blended with nylon, spun into filaments, and drawn is present in the filaments 10 as substantially cylindrical striations 12 having substantially uniform diameters 14 from end-to-end and having length 16 to diameter 14 (L/D) ratios of predominantly 50–150. The striations are uniformly distributed throughout the filament cross section, FIG. 2, and the longitudinal axis of the striations is generally parallel with the longitudinal axis of the filaments. It is these long striations which are responsible for the bright sheen luster and low or no glitter appearance of the filaments of this invention.

Figure 3:
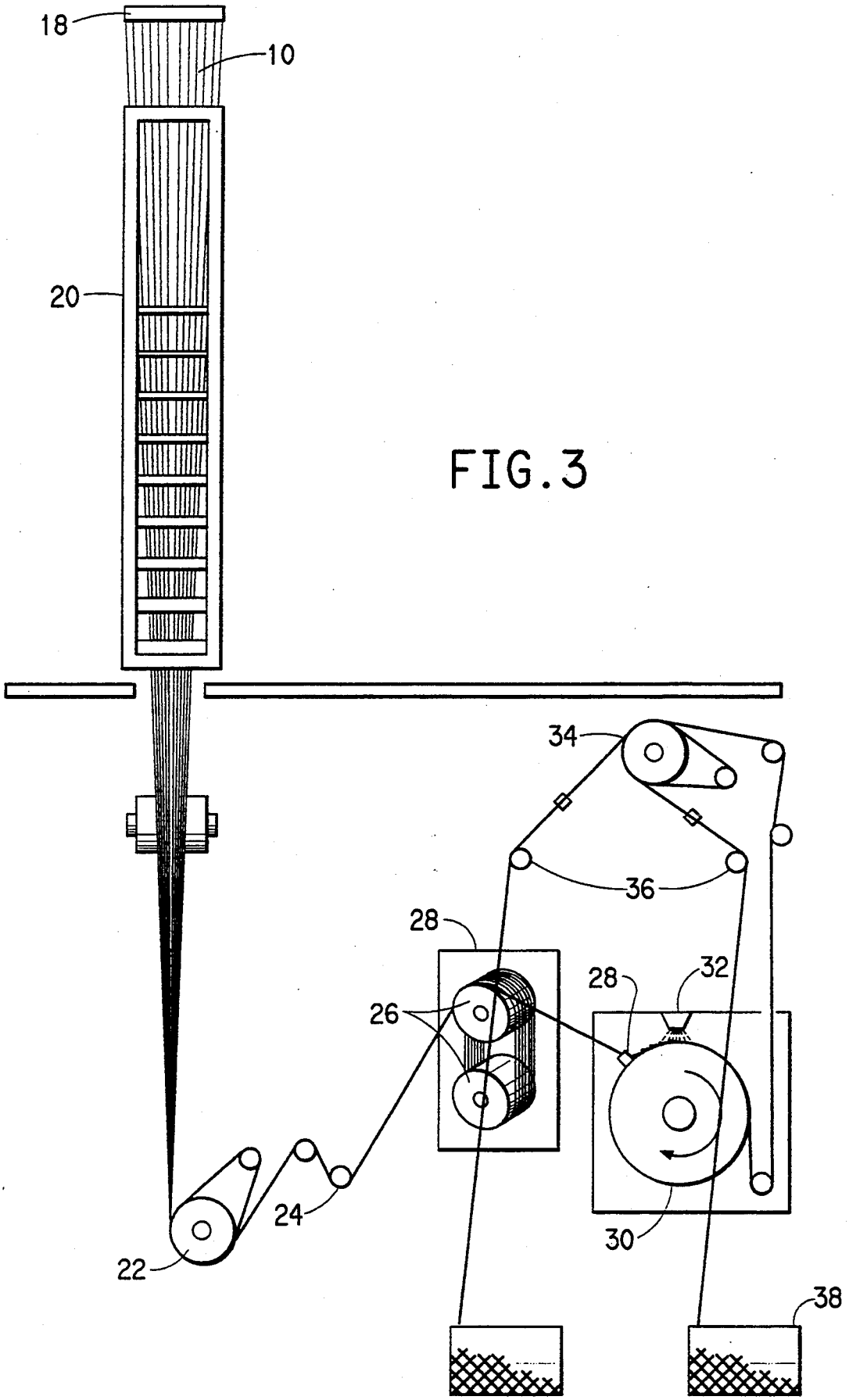
FIG. 3 is a schematic view of the process used to make fibers of this invention.

Processes for manufacturing filaments of this invention are well known. Referring to the FIG. 3, the process for manufacturing nylon 66 BCF is illustrated. However, this invention is not limited to BCF products or to nylon 66 products. The molten mixture of nylon and polymethylpentene additive is pumped through capillary 18 at a temperature of 280°–290° C.—well above the melting point of the nylon and the PMP—forming filaments 10 quenched in quench chimney 20 by air at about 10° C. Feed roll 22 controls transfer of filaments 10 around pins 24 and to skewed rolls 26. Filaments 10 are wrapped several times around skewed rolls 26 and are drawn 2.9× between rolls 26 and pins 24. Skewed rolls 26 are heated to about 150°–210° C. and are located in insulated enclosure 28 to reduce heat loss during operation. For production of staple filaments, rolls 26 would not need to be heated and after drawing many filaments would be combined into a tow, crimped and cut into staple (not shown). For BCF production, from skewed rolls 26, filaments 10 are advanced to bulking jet 28 supplied with air at 200 –235° C. at about 110 psi (about 7.5 atmosphere) of pressure. Filaments 10 are removed from bulking jet 28 by a rotating screen on drum 30 and are held on the screen by a vacuum drawn from inside the drum. Use of mist quench nozzle 32 is optional and provides a water mist cooling to filaments 10 which are removed from the screen by take-up roll 34. After take-up roll 34, a secondary finish can be added at finish applicators 36 and, from there, the filaments are transferred to windup 38.

Nylon filaments with additive polymer, such as polypropylene, polyethylene, polyethylene oxide or polystyrene, have, in the past, left a sticky polymer deposit on hot skewed rolls 26. That deposit caused adherence of filaments onto the rolls and the filaments broke and wrapped and caused machine stoppage. The present invention, using the polymethylpentene additive, yields filaments which leave either no deposits or a small amount of non-sticky deposits on rolls 26. Furthermore, the filaments of this invention have a dye lightfastness in a standard 40 hour xenon arc lightfastness test which is substantially equal to that of filaments having no PMP.

Test Methods

Melting Points of polymers are determined using a Differential Scanning Colorimeter in the usual manner.

Relative Viscosity of nylon is determined as the ratio of absolute viscosity at 25° C. of a solution of 8.4 weight percent polymer in 90% formic acid (10% water and 90% formic acid), to the absolute viscosity at 25° C. of the 90% formic acid alone.

Modification Ratio is the ratio of the radius of a circumscribed circle to the radius of an inscribed circle as measured on the cross section of a filament, as described in U.S. Pat. No. 2,939,201.

EXAMPLES

In the examples which follow, several filaments were spun and bulked.

Example 1

Filaments were made using nylon 66 (poly(hexamethylene adipamide)) and various concentration levels of PMP. The PMP for this example was poly(4-methyl-1-pentene) having a melting point of about 245° C. and a melt flow index of 75 as measured by ASTM D-1238-88 at 260° C. and 5 kg load. The nylon had a relative viscosity of 65–70.

The PMP was added in amounts of 1, 5, and 10 weight percent based on the total filaments; and the PMP was combined with the nylon in a screw extruder. Filaments were melt spun, at 280°–290° C., into 1120 denier yarns with 68 trilobal filaments of 2.5 modification ratio. The filaments, once spun, were drawn 2.9× and bulked in accordance with the general teaching of U.S. Pat. No. 4,559,196 at Column 4, lines 43–67. The hot roll temperature was 165° C.

There was a small amount of non-sticky polymeric deposit on the hot rolls at all concentration levels of PMP additive. The deposits did not adversely affect the processability. On repeating this example using a low melting additive, such as low density polypropylene, sticky polymeric deposits would have formed on the hot rolls and would have led to broken filaments.

The filaments of this example exhibited long striations when viewed under a microscope. They, also, exhibited smooth bright luster with little or no glitter. Similar fibers made under similar conditions with a similar concentration of a low density polypropylene additive would exhibit very short striations and a dull luster.

Example 2

Additional filaments were made using nylon 66 and the poly(4-methyl-1-pentene) of Example 1. The PMP was added in amounts shown in the Table. Filaments were melt spun at 290° C., into 1100 denier yarns with 68 trilobal filaments of 3.4 modification ratio. The filaments, once spun, were drawn 2.9× and bulked as described in Example 1. The hot roll and bulking jet air temperature are as shown in the Table. Values for yarn tenacity, elongation, and modulus are also shown in the Table.

As was the case with Example 1, there was a small amount of non-sticky polymeric deposit left on the hot rolls during this example; and the product exhibited long striations, a smooth bright luster, and little or no glitter.

TABLE

| Example | PMP (%) | Roll Temp (°C.) | Jet Temp (°C.) | Tenacity/Elong/Modulus (gpd)/(%)/(gpd) |
|---|---|---|---|---|
| 2-1 | 1.5 | 180 | 240 | 1.31/61/5.26 |
| 2-2 | 1.5 | 170 | 240 | |
| 2-3 | 1.5 | 190 | 240 | 1.61/58/6.32 |
| 2-4 | 3.0 | 190 | 240 | 1.29/61/5.38 |
| 2-5 | 3.0 | 180 | 240 | 1.54/66/5.97 |
| 2-6 | 3.0 | 170 | 240 | 1.57/73/5.80 |

We claim:

1. A delustered nylon filament having a longitudinal axis and comprising from 80 to 99.5 weight percent of polymer, said nylon polymer containing at least 80 weight percent nylons units selected from the group consisting of nylon 66 and nylon 6; and from 0.5 to 10 weight percent of polymethylpentene polymer, said polymethylpentene polymer being uniformly distributed in the nylon filament as cylindrical striations having a substantially uniform diameter along their length, and L/D ratio of predominantly 50 to 150, and said cylindrical striations having a longitudinal axis generally parallel with the longitudinal axis of the nylon filament.

2. The filament of claim 1 wherein the polymethylpentene polymer is poly(4-methyl-1-pentene).

3. The filament of claim 1 wherein the nylon polymer is nylon 6.

4. The filament of claim 1 wherein the nylon polymer is nylon 66.

5. The filament of claim 1 wherein the nylon filament comprises 0.5 to 3 weight percent of polymethylpentene.

6. The filament of claim 1 wherein the filament is staple.

7. The filament of claim 1 wherein the filament is bulked continuous filament.

* * * * *